US006471474B1

(12) United States Patent
Mielke et al.

(10) Patent No.: US 6,471,474 B1
(45) Date of Patent: Oct. 29, 2002

(54) METHOD AND APPARATUS FOR REDUCING ROTOR ASSEMBLY CIRCUMFERENTIAL RIM STRESS

(75) Inventors: Mark Joseph Mielke, Blanchester, OH (US); John Jared Decker, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 09/693,570

(22) Filed: Oct. 20, 2000

(51) Int. Cl.[7] ..... F01D 5/02

(52) U.S. Cl. ..... 415/199.4; 416/198 A; 416/234; 416/248; 415/914; 29/889.21

(58) Field of Search ..... 416/193 A, 193 R, 416/198 A, 201 R, 223 A, 248, 234; 415/199.4, 199.5, 914; 29/889.21, 889.22

(56) References Cited

U.S. PATENT DOCUMENTS

| | | | | |
|---|---|---|---|---|
| 1,793,468 A | | 2/1931 | Densmore | |
| 2,415,380 A | | 2/1947 | Weber | |
| 2,429,324 A | | 10/1947 | Meisser | |
| 2,735,612 A | | 2/1956 | Hausmann | |
| 2,790,620 A | | 4/1957 | Rankin | |
| 2,918,254 A | | 12/1959 | Hausammann | |
| 3,095,180 A | | 6/1963 | Clarke et al. | |
| 3,389,889 A | | 6/1968 | Penny | |
| 3,481,531 A | | 12/1969 | MacArthur et al. | |
| 3,529,631 A | | 9/1970 | Riollet | |
| 3,584,969 A | | 6/1971 | Aiki | |
| 3,661,475 A | | 5/1972 | Anderson | |
| 3,730,644 A | | 5/1973 | Jubb | |
| 3,890,062 A | | 6/1975 | Hendrix et al. | |
| 3,927,952 A | | 12/1975 | Kirby | |
| 3,951,611 A | | 4/1976 | Morrill | |
| 4,135,857 A | | 1/1979 | Pannone et al. | |
| 4,188,169 A | | 2/1980 | Mowill | |
| 4,335,997 A | | 6/1982 | Ewing et al. | |
| 4,420,288 A | | 12/1983 | Bischoff | |
| 4,465,433 A | * | 8/1984 | Bischoff | 416/193 A |
| 4,587,700 A | | 5/1986 | Curbishley et al. | |
| 4,659,288 A | | 4/1987 | Clark et al. | |
| 4,671,739 A | | 6/1987 | Read et al. | |
| 4,704,066 A | | 11/1987 | Weissbacher | |
| 4,866,985 A | | 9/1989 | Futrell, II | |
| 4,884,948 A | | 12/1989 | Sikorski | |
| 5,007,801 A | | 4/1991 | Hopfensperger et al. | |
| 5,018,271 A | | 5/1991 | Bailey et al. | |
| 5,061,154 A | | 10/1991 | Kington | |
| 5,215,439 A | | 6/1993 | Jansen et al. | |
| 5,244,345 A | | 9/1993 | Curtis | |
| 5,397,215 A | * | 3/1995 | Spear et al. | 415/914 |
| 5,466,123 A | | 11/1995 | Rose | |
| 5,554,004 A | | 9/1996 | Stewart | |
| 5,628,621 A | * | 5/1997 | Toborg | 416/198 A |
| 5,735,673 A | | 4/1998 | Matheny et al. | |
| 5,775,878 A | | 7/1998 | Maumus et al. | |
| 6,017,186 A | * | 1/2000 | Hoeger et al. | 416/248 |
| 6,213,711 B1 | * | 4/2001 | Muller et al. | 415/914 |

FOREIGN PATENT DOCUMENTS

| | | |
|---|---|---|
| DE | 191354 | 8/1957 |
| SU | 756083 | 8/1980 |

* cited by examiner

*Primary Examiner*—Christopher Verdier
(74) *Attorney, Agent, or Firm*—Rodney M. Young; Armstrong Teasdale LLP

(57) ABSTRACT

A rotor assembly for a gas turbine engine operates with reduced circumferential rim stress. The rotor assembly includes a rotor including a plurality of rotor blades extending radially outward from an annular rim. A root fillet extends circumferentially around each blade between the blades and rim. The rim includes an outer surface including a plurality of concave indentations extending between adjacent rotor blades and forming a compound radius. Each indentation extends from a leading edge of the rotor blades towards a trailing edge of the rotor blades.

20 Claims, 3 Drawing Sheets

METHOD AND APPARATUS FOR REDUCING ROTOR ASSEMBLY CIRCUMFERENTIAL RIM STRESS

BACKGROUND OF THE INVENTION

This application relates generally to gas turbine engines and, more particularly, to a flowpath through a blisk rotor assembly.

A gas turbine engine typically includes at least one rotor including a plurality of rotor blades extending radially outwardly from a common annular rim. Specifically, in blisk rotors, the rotor blades are formed integrally with the annular rim rather than attached to the rim with dovetail joints. An outer surface of the rim typically defines a radially inner flowpath surface for air flowing through the rotor assembly.

Centrifugal forces generated by the rotating blades are carried by portions of the rims below the rotor blades. The centrifugal forces generate circumferential rim stress concentration between the rim and the blades. Additionally, a thermal gradient between the rim and the rotor disk during transient operations generates thermal stresses which may adversely impact a low cycle fatigue life of the rotor assembly. Also, because the rim is exposed directly to the flowpath air, thermal gradients and rim stress concentrations may be increased. Furthermore, as the rotor blades rotate, blade roots may generate local forces that may further increase the rim stress concentration.

To reduce the effects of circumferential rim stress concentration, additional material is provided at each root fillet to increase a radius of the root fillet. However, because the root fillets are exposed to the flowpath air, the additional material attached to the root fillets may be detrimental to flow performance.

Other known rotor assemblies include a plurality of indentations extending between adjacent rotor blades over an axial portion of the rims between the rim leading and trailing edges. The indentations are defined and formed as integral compound features in combination with the root fillets and rotor blades. Typically such indentations are formed using an electrochemical machining, ECM, process. Because of dimensional control limitations that may be inherent with the ECM process, surface irregularities may be unavoidably produced. Such surface irregularities may produce stress radii on the rim which may result in increased surface stress concentrations. The surface irregularities therefore are milled with hand bench operations. Such hand bench operations increase production costs for the rotor assembly. Furthermore, because such indentations extend to the rim trailing edge, a forward facing step is created for an adjacent downstream stator stage. Such steps may be detrimental to flow performance.

BRIEF SUMMARY OF THE INVENTION

In an exemplary embodiment, a blisk rotor assembly includes an outer rim including a curved outer surface for facilitating a reduction in circumferential rim stress generated during engine operations. More specifically, in the exemplary embodiment, the rotor assembly includes a blisk rotor including a plurality of rotor blades and a radially outer rim. The rotor blades are integrally formed with the rim and extend radially outward from the rim. A root fillet provides support to rotor blade/rim interfaces and extends circumferentially around each rotor blade/rim interface between the rotor blade and rim. The rim includes an outer surface having a concave curved indentation extending between adjacent rotor blades. Each curved indentation extends from a leading edge of the rotor blade towards a trailing edge of the rotor blade and forms a compound radius. The compound radius includes a first radius and a second radius. The first radius is defined by a root fillet adjacent a pressure side of each rotor blade and the second radius is larger than the first radius and extends from the first radius. Each indentation is tapered to end within a portion of the outer rim between adjacent rotor blades.

During operation, as the rotor blades rotate, centrifugal loads generated by the blades are carried by portions of the outer rim below each rotor blade. As air flows between adjacent rotor blades, the outer rim facilitates a reduction in thermal gradients that may be generated between the rotor blades and the outer rim, thus reducing thermal stresses that could impact a low cycle fatigue life (LCF) of the rotor assembly in comparison to at least some other known rotor assemblies. The curved surface provides stress shielding and reduce stress concentrations by interrupting circumferential stresses below the rotor blade root fillets. Because the second radius is larger than the first radius, a lower stress concentration is generated in the circumferential stress field and less circumferential rim stress concentration is generated between the rim and the rotor blades in comparison to at least some other known rotor assemblies. As a result, the rotor assembly facilitates high efficiency operation and a reduction in circumferential rim stress concentration.

DETAILED DESCRIPTION OF THE INVENTION

Figure 1:
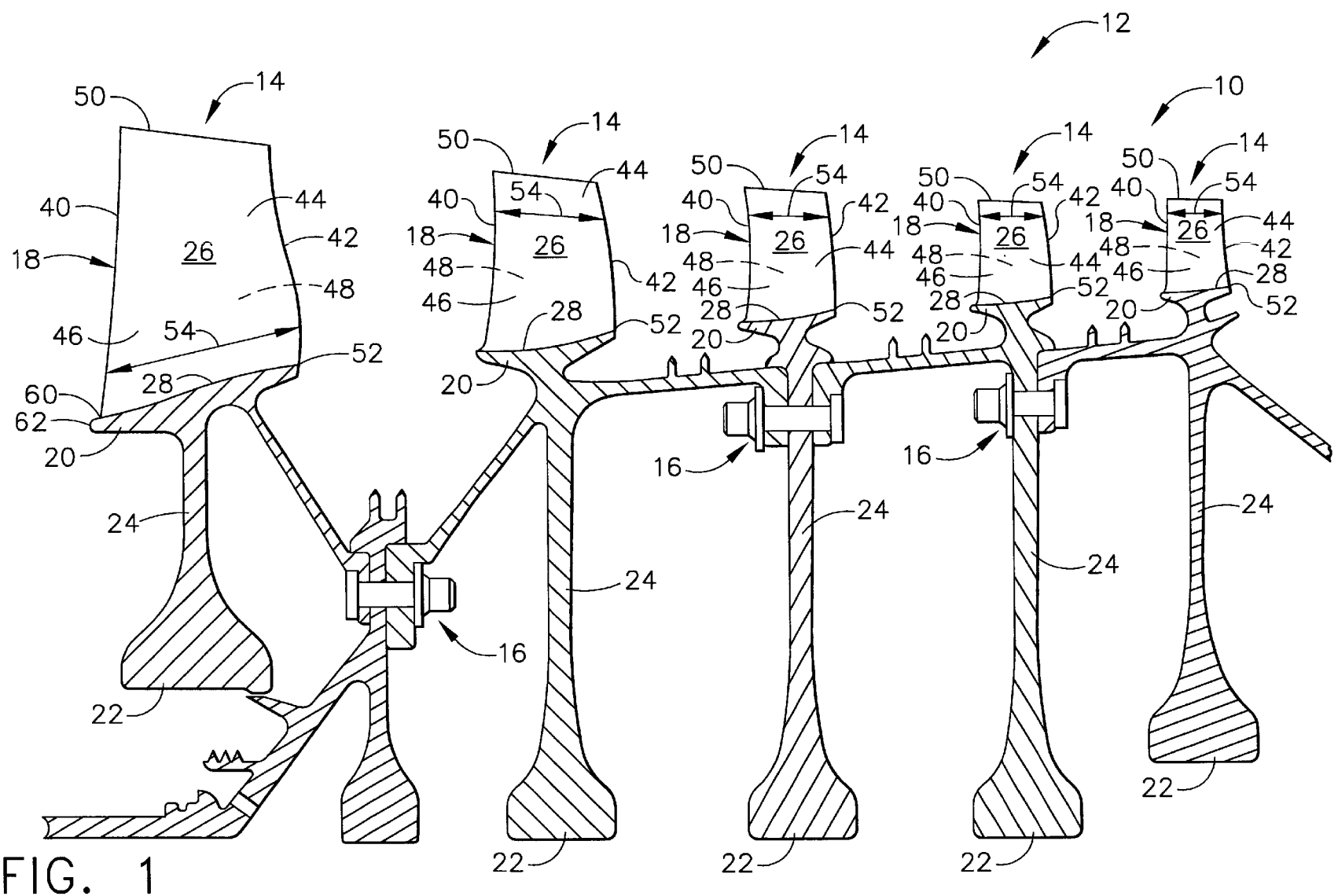
FIG. 1 is schematic illustration of a portion of a rotor assembly for a gas turbine engine.

FIG. 1 is a schematic illustration of a portion of a rotor assembly 10 used with a gas turbine engine 12. In one embodiment, gas turbine engine 12 is a F414 engine commercially available from General Electric Company, Cincinnati, Ohio. In an exemplary embodiment, rotor assembly 10 includes rotors 14 joined together by couplings 16 coaxially about an axial centerline axis (not shown). Each rotor 14 is formed by one or more blisks 18, and each blisk 18 includes an annular radially outer rim 20, a radially inner hub 22, and an integral web 24 extending radially therebetween. Each blisk 18 also includes a plurality of blades 26 extending radially outwardly from rim 20. Blades 26, in the embodiment illustrated in FIG. 1, are integrally joined with respective rims 20. Alternatively, and for at least one stage, each rotor blade 26 may be removably joined to rims 20 in a known manner using blade dovetails (not shown) which mount in complementary slots (not shown) in a respective rim 20.

In the exemplary embodiment illustrated in FIG. 1, five rotor stages are illustrated with rotor blades 26 configured for cooperating with a motive or working fluid, such as air. In the exemplary embodiment illustrated in FIG. 1, rotor assembly 10 is a compressor of gas turbine engine 12, with rotor blades 26 configured for suitably compressing the motive fluid air in succeeding stages. Outer surfaces 28 of rotor rims 20 define a radially inner flowpath surface of the compressor as air is compressed from stage to stage.

Blades 26 rotate about the axial centerline axis up to a specific maximum design rotational speed, and generate centrifugal loads in rotating components. Centrifugal forces generated by rotating blades 26 are carried by portions of rims 20 directly below each blade 26. Rotation of rotor assembly 10 and blades 26 imparts energy into the air which is initially accelerated and then decelerated by diffusion for recovering energy to pressurize or compress the air. The radially inner flowpath is bound circumferentially by adjacent rotor blades 26 and is bound radially with a shroud (not shown).

Rotor blades 26 each include a leading edge 40, a trailing edge 42, and a body 44 extending therebetween. Body 44 includes a suction side 46 and a circumferentially opposite pressure side 48. Suction and pressure sides 46 and 48, respectively, extend between axially spaced apart leading and trailing edges 40 and 42, respectively and extend in radial span between a rotor blade tip 50 and a rotor blade root 52. A blade chord 54 is measured between rotor blade trailing and leading edges 42 and 40, respectively. Rotor blades 26 also include a leading edge root fillet 60 extending between rotor blade leading edge 40 and a rim nose 62. Rim nose 62 is axisymmetric. In one embodiment, rim nose 62 is fabricated with a lathe.

Figure 2:
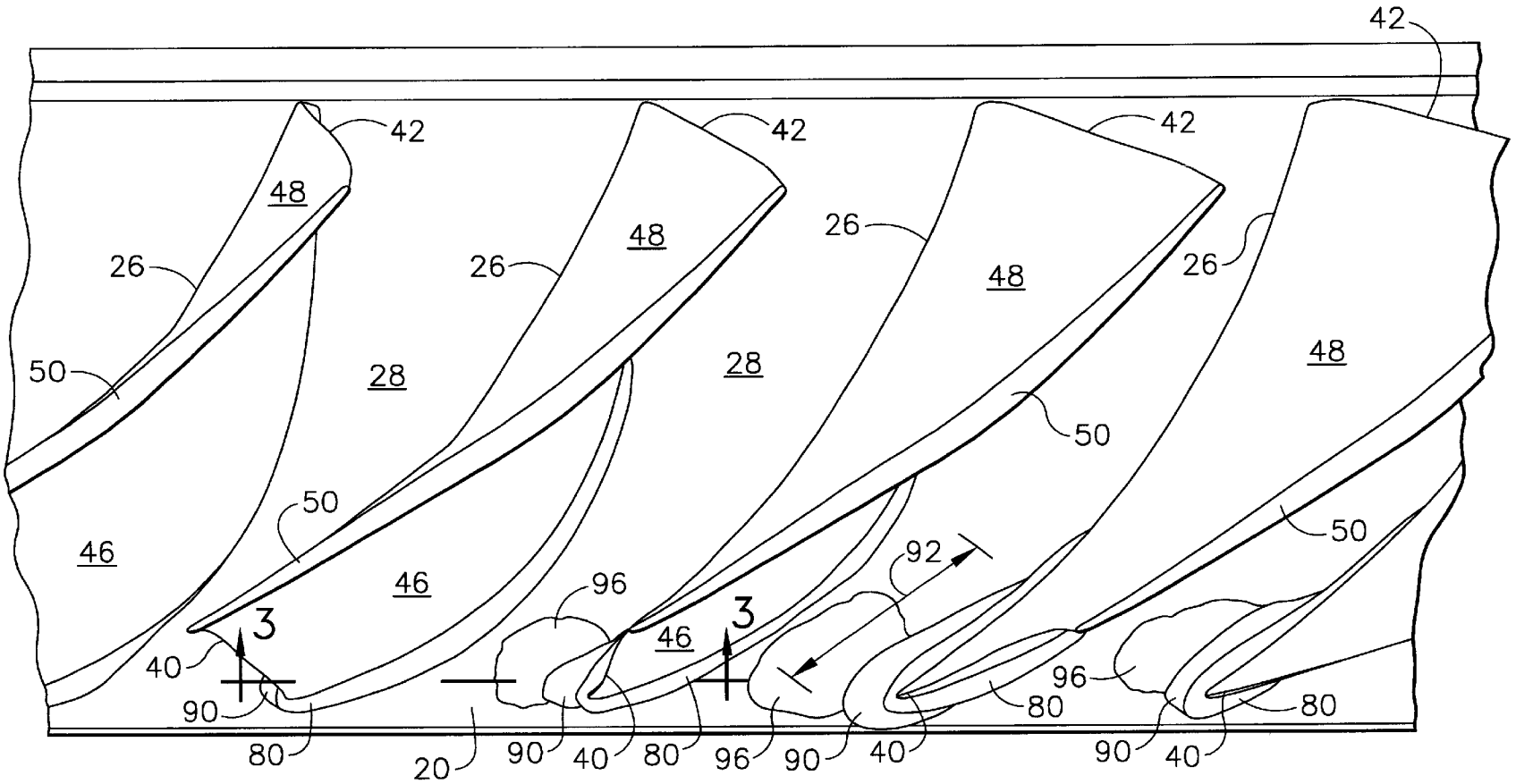
FIG. 2 is a top plan view of a portion of the rotor assembly shown in FIG. 1.
Figure 3:
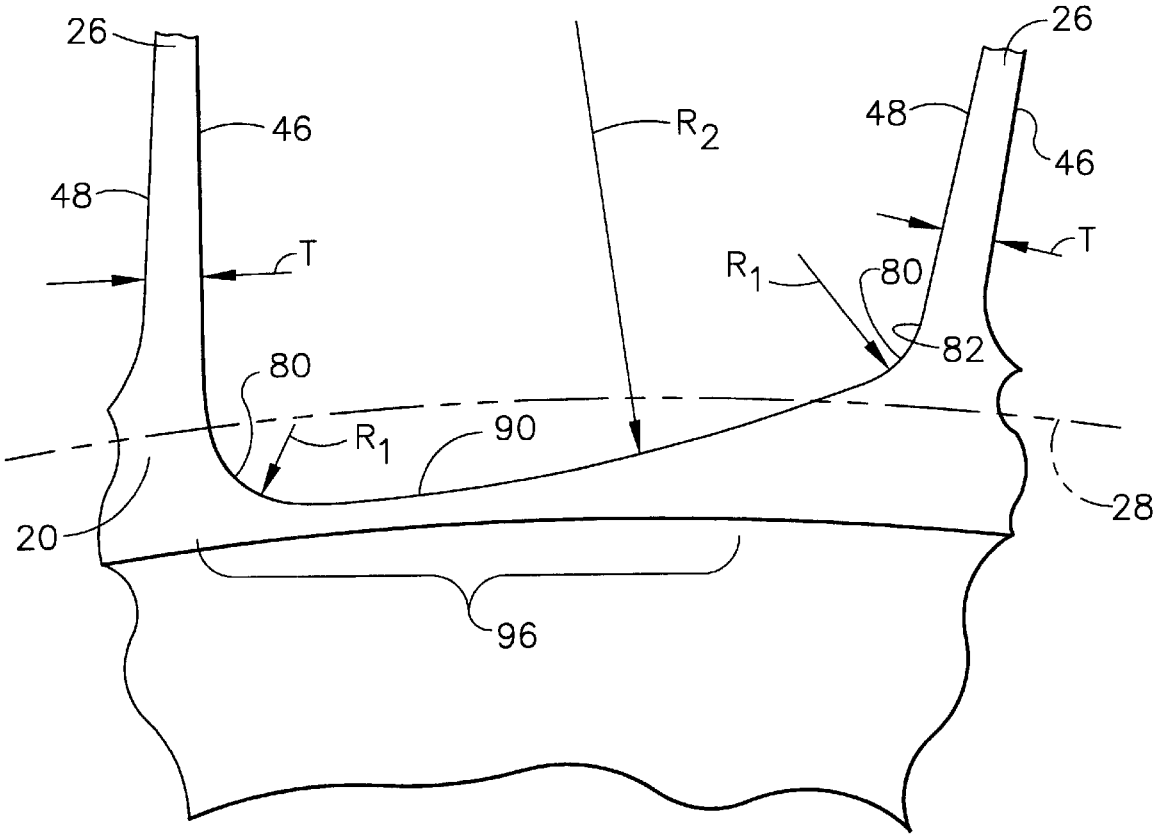
FIG. 3 is a cross-sectional view of a portion of the rotor assembly shown in FIG. 2.

FIG. 2 is a top plan view of a portion of rotor assembly 10 including rotor blades 26 extending radially outwardly from outer rim 20. FIG. 3 is a cross-sectional view of a portion of rotor assembly 10 taken along line 3—3 shown in FIG. 2. A rotor blade root fillet 80 circumscribes each rotor blade 26 adjacent rotor blade root 52 and extends between rotor blade 26 and rim outer surface 28. Each root fillet 80 is formed by a radius $R_1$, such that each root fillet 80 tapers circumferentially outwardly from an apex 82 adjacent rotor blade root fillet 80. In one embodiment, root fillet radius $R_1$ is equal approximately 25–75% of a rotor blade thickness, T.

A concave shape curved surface 90 is indented and extends from root fillet 80 between adjacent rotor blades 26. More specifically, each curved surface 90 extends between adjacent rotor blade fillets 80 and is formed adjacent each rotor blade pressure side 48. Each curved surface 90 extends from rotor blade leading edge 40 aftward towards rotor blade trailing edge 42 for a distance 92. Distance 92 is less than blade root chord 54. Curved surface 90 tapers such that at distance 92, curved surface 90 ends and outer surface 28 extends between adjacent rotor blade root fillets 80 and does not include curved surface 90. In one embodiment, distance 92 is between approximately 10–20% of blade root chord 54 (shown in FIG. 1).

Each curved surface 90 generates a compound radius with each root fillet 80. The compound radius is adjacent each rotor blade pressure side 48 and each compound radius includes a first radius, $R_1$, defined by root fillet 80, and a second radius, $R_2$, larger than first radius $R_1$. In one embodiment, second radius, $R_2$ is approximately 5–10 times larger than first radius, $R_1$. Curved surface 90 is formed using, for example a milling operation, and may be defined and manufactured independently of rotor blades 26. Because curved surface 90 is defined independently of rotor blades 26, curved surface 90 may be added to existing fielded parts (not shown) to extend a useful life of such parts.

A portion 96 of rim outer surface 28 is depressed radially inward from a nominal flowpath adjacent blade root fillet 80 between adjacent rotor blades 26. Rim outer surface 96 permits a recovery of airflow between adjacent rotor blades 26 which would otherwise be blocked by compound fillet 90.

During operation, as blades 26 rotate, centrifugal loads generated by rotating blades 26 are carried by portions of rims 20 below rotor blades 26. Outer surface 28 of rim 20 defines a radially inner flowpath surface for rotor assembly 10 as air is compressed from stage to stage. By providing that rim outer surface 28 includes concave curved surface 90, airflow is generally directed away from immediately adjacent blades 26 towards a center (not shown) of the flowpath between adjacent blades 26, which reduces aerodynamic performance losses. More specifically, because of concave curved surface 90, air flowing around rotor blade pressure side 48 is at a higher radial height with respect to rim outer surface 28 than air flowing around rotor blade suction side 46. Each depressed rim outer surface portion 96 permits a recovery of airflow between adjacent rotor blades 26 which would otherwise be blocked by compound fillet 90.

Curved surface 90 provides stress shielding and further facilitates reducing hoop stress concentrations by interrupting circumferential stresses at a depth below that of root fillets 80. Because curved surface radius $R_2$ is larger than root fillet radius $R_1$, less stress concentration is generated in the same circumferential stress field and less circumferential rim stress concentration is generated between rim 20 and rotor blades 26 at a location of the blade/rim interface (not shown) than may be generated if indentations radius $R_2$ was not larger than root fillet radius $R_1$. Reducing such stress concentration at the interface facilitates extending the LCF life of rim 20.

Variations of the above-described embodiment are possible. For example, more complex shapes other than a concave compound radius shape can be selected for rim outer surface 28 between adjacent blades 26. Generally, the shape of outer surface 28 is selected to effectively reduce circumferential rim stress concentration generated in rim 20. Further, rather than fabricating rim 20 to include curved surface 90 or forming curved surface 90 using fillet welding, each rotor blade 26 can be fabricated to provide desired curved surface 90 at a location of a blade/rim interface.

The above-described rotor assembly is cost-effective and highly reliable. The rotor assembly includes a plurality of rotor blades extending radially outward from an outer rim that includes a convex shape. The rim includes a plurality of circumferentially concave indentations extending between adjacent rotor blades from a rotor blade leading edge towards a rotor blade trailing edge along a rotor blade suction side. The indentation tapers within the outer rim outer surface between the rotor leading and trailing edges. During operation, the compound radius of the curved surface provides stress shielding and reduces stress concentrations by interrupting circumferential stresses below a rotor blade root fillet tangency point. As a result, less circumferential rim stress concentration is generated between the rotor blades and the rim. In addition, the indentation facilitates increased airflow between the blades.

While the invention has been described in terms of various specific embodiments, those skilled in the art will recognize that the invention can be practiced with modification within the spirit and scope of the claims.

What is claimed is:

1. A method of fabricating a rotor assembly to facilitate reducing circumferential rim stress concentration in a gas turbine engine, the rotor assembly including a rotor that includes a radially outer rim and a plurality of rotor blades extending radially outward from the outer rim, the outer rim including an outer surface, each rotor blade including a leading edge and a trailing edge, said method comprising the steps of:

forming a plurality of circumferentially concave indentations into the outer rim between adjacent rotor blades, wherein each indentation includes a compound radius that extends circumferentially between adjacent blades; and extending the indentations from the rotor blade leading edge towards the rotor blade trailing edge, such that the indentations do not extend to the trailing edge.

2. A method in accordance with claim 1 wherein said step of forming a plurality of indentations further comprises the step of forming the compound radius to include a first radius and a second radius that is smaller than the first radius.

3. A method in accordance with claim 2 wherein said step of forming a plurality of indentations further comprises the step of forming the compound radius such that the first radius is approximately ten times larger than the second radius.

4. A method in accordance with claim 2 wherein each rotor blade includes a root fillet extending between the outer rim outer surface and the rotor blade, said step of forming a plurality of indentations further comprises the step of forming the compound radius such that the second radius is defined by the rotor blade root fillet.

5. A method in accordance with claim 1 wherein each rotor blade includes a pressure side and a circumferentially opposite suction side, said step of forming a plurality of indentations further comprises the step of forming a plurality of indentations adjacent each rotor blade suction side.

6. A rotor assembly for a gas turbine engine, said rotor assembly comprising a rotor comprising a radially outer rim and a plurality of rotor blades extending radially outward from said radially outer rim, said outer rim comprising an outer surface, each said rotor blade comprising a leading edge, and a trailing edge, said outer rim outer surface comprising a circumferentially concave shape including a compound radius, said concave shape extending over a portion of said outer surface from said rotor blade leading edge towards said rotor blade trailing edge between adjacent said rotor blades such that said concave shape does not extend to said rotor blade trailing edge, said concave shape extending circumferentially between adjacent rotor blades and configured to reduce circumferential rim stress concentration between said rotor blades and said radially outer rim.

7. A rotor assembly in accordance with claim 6 wherein said rotor further comprises a plurality of blisks.

8. A rotor assembly in accordance with claim 6 wherein said compound radius comprises a first radius and a second radius, said first radius approximately ten times larger than said second radius.

9. A rotor assembly in accordance with claim 6 wherein each of said plurality of rotor blades further comprises a pressure side and a suction side, said pressure side circumferentially opposite said suction side, said concave shape extending along each of said rotor blade suction sides.

10. A rotor assembly in accordance with claim 6 wherein each of said plurality of rotor blades further comprises a root fillet extending between said outer rim outer surface and said rotor blade.

11. A rotor assembly in accordance with claim 10 wherein said compound radius comprises a first radius and a second radius, said first radius approximately ten times larger than said second radius, said second radius defined by said root fillet.

12. A rotor assembly in accordance with claim 6 wherein said outer rim concave shape directs air flow away from an interface between each of said rotor blades and said outer rim.

13. A rotor assembly in accordance with claim 6 wherein said outer rim concave shape configured to increase airflow between adjacent said rotor blades.

14. A gas turbine engine comprising a rotor assembly comprising a rotor comprising a radially outer rim and a plurality of rotor blades extending radially outward from said radially outer rim, said outer rim comprising an outer surface, each said plurality of rotor blades comprising a leading edge and a trailing edge, said outer rim outer surface comprising a compound radius, a concave shape extending over a portion of said outer surface from said rotor blade leading edge towards said rotor blade trailing edge between adjacent said rotor blades such that said concave shape does not extend to said rotor blade trailing edge, said concave shape configured to reduce circumferential rim stress concentration between said rotor blades and said radially outer rim.

15. A gas turbine engine in accordance with claim 14 wherein said rotor assembly outer rim surface further comprises a circumferentially concave shape between adjacent said rotor blades.

16. A gas turbine engine in accordance with claim 14 wherein said rotor assembly compound radius comprises a first radius and a second radius, said rotor assembly first radius approximately ten times larger than said second radius.

17. A gas turbine engine in accordance with claim 16 wherein each of said rotor blades further comprises a root fillet extending between said rotor assembly outer rim and said rotor blades, said rotor assembly compound second radius defined by said rotor blade root fillets.

18. A gas turbine engine in accordance with claim 14 wherein each of said plurality of rotor blades further comprises a pressure side and a suction side, said concave shape extending along each of said rotor blade suction sides.

19. A gas turbine engine in accordance with claim 14 wherein said rotor assembly rotor further comprises a plurality of blisks.

20. A gas turbine engine in accordance with claim 14 wherein said rotor assembly outer rim concave shape directs air flow away from an interface between each of said rotor assembly rotor blades and said rotor assembly outer rim.

* * * * *